US007773763B2

(12) United States Patent
Pedersen

(10) Patent No.: US 7,773,763 B2
(45) Date of Patent: Aug. 10, 2010

(54) BINAURAL HEARING AID SYSTEM WITH COORDINATED SOUND PROCESSING

(75) Inventor: Brian Dam Pedersen, Ringsted (DK)

(73) Assignee: GN ReSound A/S (DK)

( * ) Notice: Subject to any disclaimer, the term of this patent is extended or adjusted under 35 U.S.C. 154(b) by 658 days.

(21) Appl. No.: 10/561,476

(22) PCT Filed: Jun. 23, 2004

(86) PCT No.: PCT/DK2004/000442

§ 371 (c)(1),
(2), (4) Date: Apr. 18, 2007

(87) PCT Pub. No.: WO2004/114722

PCT Pub. Date: Dec. 29, 2004

(65) Prior Publication Data

US 2008/0212810 A1 Sep. 4, 2008

(30) Foreign Application Priority Data

Jun. 24, 2003 (DK) ..... 2003 00944

(51) Int. Cl.
*H04R 25/00* (2006.01)

(52) U.S. Cl. ..... 381/321; 381/313; 381/315; 381/317

(58) Field of Classification Search ..... 381/23.1, 381/312–331
See application file for complete search history.

(56) References Cited

U.S. PATENT DOCUMENTS 5,687,241 A 11/1997 Ludvigsen
5,757,932 A * 5/1998 Lindemann et al. ..... 381/312
6,549,633 B1 * 4/2003 Westermann ..... 381/312
6,768,802 B1 * 7/2004 Baechler ..... 381/315
7,020,296 B2 * 3/2006 Niederdrank ..... 381/315
7,158,931 B2 * 1/2007 Allegro ..... 704/225
7,254,246 B2 * 8/2007 Jakob ..... 381/315

(Continued)

FOREIGN PATENT DOCUMENTS

WO WO 99/43185 8/1999

(Continued)

*Primary Examiner*—Curtis Kuntz
*Assistant Examiner*—Ryan Robinson
(74) *Attorney, Agent, or Firm*—Vista IP Law Group, LLP.

(57) ABSTRACT

The present invention relates to a binaural hearing aid system comprising a first hearing aid and a second hearing aid, each of which comprises a microphone and an A/D converter for provision of a digital input signal in response to sound signals received at the respective microphone in a sound environment, a processor that is adapted to process the digital input signals in accordance with a predetermined signal processing algorithm to generate a processed output signal, and a D/A converter and an output transducer for conversion of the respective processed sound signal to an acoustic output signal, and a binaural sound environment detector for binaural determination of the sound environment surrounding a user of the binaural hearing aid system based on at least one signal from the first hearing aid and at least one signal from the second hearing aid for provision of outputs for each of the first and second hearing aids for selection of the signal processing algorithm of each of the respective hearing aid processors so that the hearing aids of the binaural hearing aid system perform coordinated sound processing.

23 Claims, 5 Drawing Sheets

U.S. PATENT DOCUMENTS

| | | | | |
|---|---|---|---|---|
| 7,286,672 | B2 * | 10/2007 | Roeck | 381/23.1 |
| 7,474,758 | B2 * | 1/2009 | Beck et al. | 381/313 |
| 2002/0037087 | A1 | 3/2002 | Allegro et al. | |

FOREIGN PATENT DOCUMENTS

| | | | |
|---|---|---|---|
| WO | WO 01/76321 | A1 | 10/2001 |
| WO | WO 02/28143 | A2 | 4/2002 |
| WO | WO 02/28143 | A3 | 4/2002 |
| WO | WO 02/32208 | A2 | 4/2002 |
| WO | WO 02/32208 | A3 | 4/2002 |

* cited by examiner

BINAURAL HEARING AID SYSTEM WITH COORDINATED SOUND PROCESSING

The present application is the national stage filing of PCT International Application No. PCT/DK2004/000442, filed Jun. 23, 2004, which in turn claims the benefit of priority to Danish Patent Application No. PA 2003 00944, filed Jun. 24, 2003, the disclosures of which are expressly incorporated herein by reference.

FIELD OF THE INVENTION

The present invention relates to a binaural hearing aid system with a first hearing aid and a second hearing aid, each of which comprises a microphone, an A/D converter for provision of a digital input signal in response to sound signals received at the respective microphone in a sound environment, a processor that is adapted to process the digital input signals in accordance with a predetermined signal processing algorithm to generate a processed output signal, and a D/A converter and an output transducer for conversion of the respective processed sound signal to an acoustic output signal.

BACKGROUND OF THE INVENTION

Today's conventional hearing aids typically comprise a Digital Signal Processor (DSP) for processing of sound received by the hearing aid for compensation of the user's hearing loss. As is well known in the art, the processing of the DSP is controlled by a signal processing algorithm having various parameters for adjustment of the actual signal processing performed. The gains in each of the frequency channels of a multi-channel hearing aid are examples of such parameters.

The flexibility of the DSP is often utilized to provide a plurality of different algorithms and/or a plurality of sets of parameters of a specific algorithm. For example, various algorithms may be provided for noise suppression, i.e. attenuation of undesired signals and amplification of desired signals. Desired signals are usually speech or music, and undesired signals can be background speech, restaurant clatter, music (when speech is the desired signal), traffic noise, etc.

The different algorithms or parameter sets are typically included to provide comfortable and intelligible reproduced sound quality in different sound environments, such as speech, babble speech, restaurant clatter, music, traffic noise, etc. Audio signals obtained from different sound environments may possess very different characteristics, e.g. average and maximum sound pressure levels (SPLs) and/or frequency content. Therefore, in a hearing aid with a DSP, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Consequently, today's DSP based hearing instruments are usually provided with a number of different programs, each program tailored to a particular sound environment category and/or particular user preferences. Signal processing characteristics of each of these programs is typically determined during an initial fitting session in a dispenser's office and programmed into the instrument by activating corresponding algorithms and algorithm parameters in a non-volatile memory area of the hearing aid and/or transmitting corresponding algorithms and algorithm parameters to the non-volatile memory area.

Some known hearing aids are capable of automatically classifying the user's sound environment into one of a number of relevant or typical everyday sound environment categories, such as speech, babble speech, restaurant clatter, music, traffic noise, etc.

Obtained classification results may be utilised in the hearing aid to automatically select signal processing characteristics of the hearing aid, e.g. to automatically switch to the most suitable algorithm for the environment in question. Such a hearing aid will be able to maintain optimum sound quality and/or speech intelligibility for the individual hearing aid user in various sound environments.

U.S. Pat. No. 5,687,241 discloses a multi-channel DSP based hearing instrument that utilises continuous determination or calculation of one or several percentile values of input signal amplitude distributions to discriminate between speech and noise input signals. Gain values in each of a number of frequency channels are adjusted in response to detected levels of speech and noise.

However, it is often desirable to provide a more subtle characterization of a sound environment than only discriminating between speech and noise. As an example, it may be desirable to switch between an omni-directional and a directional microphone preset program in dependence of, not just the level of background noise, but also on further signal characteristics of this background noise. In situations where the user of the hearing aid communicates with another individual in the presence of the background noise, it would be beneficial to be able to identify and classify the type of background noise. Omni-directional operation could be selected in the event that the noise being traffic noise to allow the user to clearly hear approaching traffic independent of its direction of arrival. If, on the other hand, the background noise was classified as being babble-noise, the directional listening program could be selected to allow the user to hear a target speech signal with improved signal-to-noise ratio (SNR) during a conversation.

Applying Hidden Markov Models for analysis and classification of the microphone signal may obtain a detailed characterisation of e.g. a microphone signal. Hidden Markov Models are capable of modelling stochastic and non-stationary signals in terms of both short and long time temporal variations. Hidden Markov Models have been applied in speech recognition as a tool for modelling statistical properties of speech signals. The article "A Tutorial on Hidden Markov Models and Selected Applications in Speech Recognition", published in Proceedings of the IEEE, VOL 77, No. 2, February 1989 contains a comprehensive description of the application of Hidden Markov Models to problems in speech recognition.

WO 01/76321 discloses a hearing aid that provides automatic identification or classification of a sound environment by applying one or several predetermined Hidden Markov Models to process acoustic signals obtained from the listening environment. The hearing aid may utilise determined classification results to control parameter values of a signal processing algorithm or to control switching between different algorithms so as to optimally adapt the signal processing of the hearing aid to a given sound environment.

The different available signal processing algorithms may change the signal characteristics significantly. In binaural hearing aid systems, it is therefore important that the determination of sound environment does not differ for the two hearing aids. However, since sound characteristics may differ significantly at the two ears of a user, it will often occur that sound environment determination at the two ears of a user differs, and this leads to undesired different signal processing of sounds for each of the ears of the user.

SUMMARY OF THE INVENTION

Thus, there is a need for a binaural hearing aid system wherein sound environment determination does not differ for the two hearing aids so that signal processing in the two hearing aids may be coordinated and the user be provided with desired processed sound in both ears at the same time.

According to the present invention, this and other objects are solved by provision of a binaural hearing aid system of the above-mentioned type wherein the hearing aids are connected either by wire or by a wireless link to at least one binaural sound environment detector for binaural determination of the sound environment surrounding a user of the binaural hearing aid system based on at least one signal from the first hearing aid and at least one signal from the second hearing aid whereby the sound environment is determined and classified based on binaural signals. The one or more binaural sound environment detectors provide outputs for each of the first and second hearing aids for selection of the signal processing algorithm of each of the hearing aid processors so that the hearing aids of the binaural hearing aid system perform coordinated sound processing.

In this way both hearing aids may process sound in response to a common determination of sound environment. Sound environment determination may be performed by one common environment detector, for example situated in one of the hearing aids or in a remote control, or, by a plurality of environment detectors, such as an environment detector in each of the first and second hearing aids.

In the event that the user has substantially the same hearing loss in both ears and the sound environment is omni-directional, i.e. the sound environment does not change with direction, coordination of sound processing in the hearing aids leads to execution of identical signal processing algorithms in the respective signal processors of the hearing aids. In the event that the hearing aid user suffers from a binaural hearing loss, the signal processing algorithms may desirably differ for compensation of the different binaural hearing losses.

It is an important advantage of the present invention that binaural sound environment detection is more accurate than monaural detection since signals from both ears are taken into account.

It is a further advantage of the present invention that signal processing in the hearing aids of the binaural hearing aid system is coordinated since the sound environment detection is the same for both hearing aids.

BRIEF DESCRIPTION OF THE DRAWINGS

For a better understanding of the present invention reference will now be made, by way of example, to the accompanying drawings, in which.

DETAILED DESCRIPTION OF PREFERRED EMBODIMENTS

Figure 1:
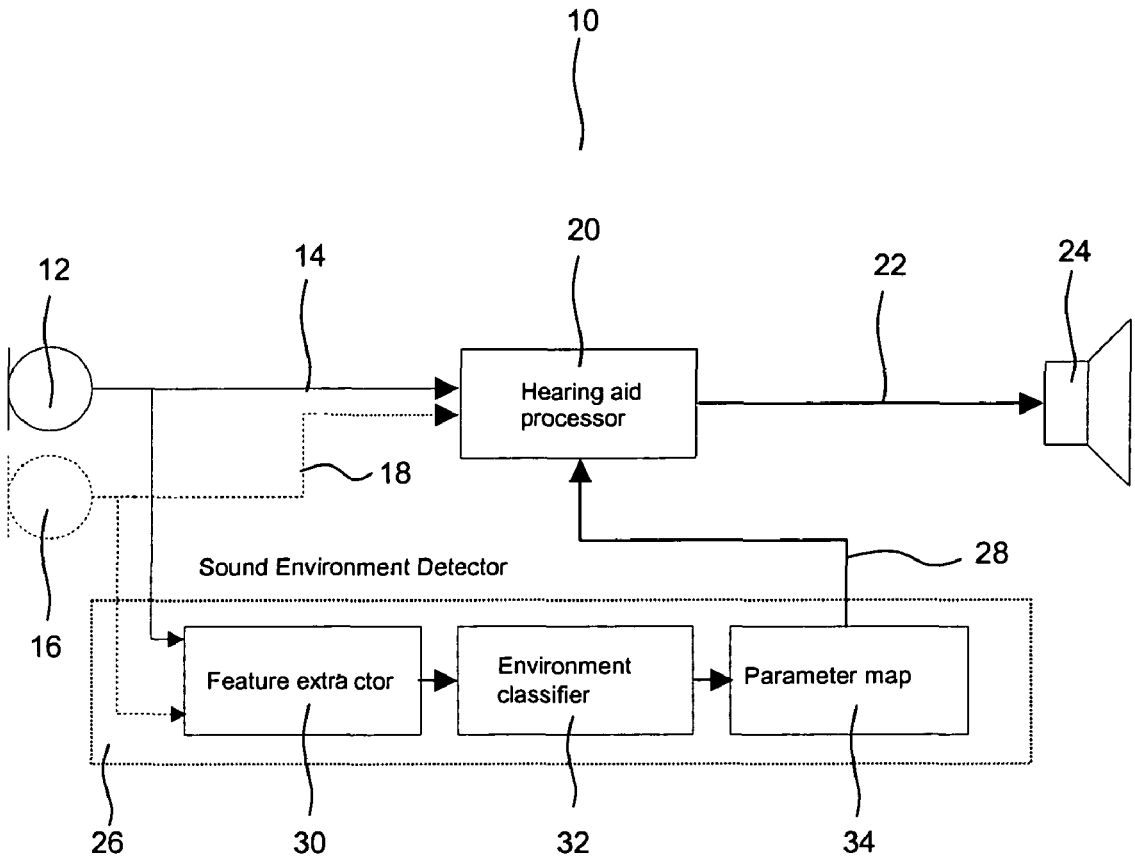
FIG. 1 illustrates schematically a prior art monaural hearing aid with sound environment classification.

FIG. 1 illustrates schematically a prior art monaural hearing aid 10 with sound environment classification.

The monaural hearing aid 10 comprises a first microphone 12 and a first A/D converter (not shown) for provision of a digital input signal 14 in response to sound signals received at the microphone 12 in a sound environment, and a second microphone 16 and a second A/D converter (not shown) for provision of a digital input signal 18 in response to sound signals received at the microphone 16, a processor 20 that is adapted to process the digital input signals 14, 18 in accordance with a predetermined signal processing algorithm to generate a processed output signal 22, and a D/A converter (not shown) and an output transducer 24 for conversion of the respective processed sound signal 22 to an acoustic output signal.

The hearing aid 10 further comprises a sound environment detector 26 for determination of the sound environment surrounding a user of the hearing aid 10. The determination is based on the output signals of the microphones 12, 16. Based on the determination, the sound environment detector 26 provides outputs 28 to the hearing aid processor 20 for selection of the signal processing algorithm appropriate in the determined sound environment. Thus, the hearing aid processor 20 is automatically switched to the most suitable algorithm for the determined environment whereby optimum sound quality and/or speech intelligibility is maintained in various sound environments.

The signal processing algorithms of the processor 20 may perform various forms of noise reduction and dynamic range compression as well as a range of other signal processing tasks.

The sound environment detector 26 comprises a feature extractor 30 for determination of characteristic parameters of the received sound signals. The feature extractor 30 maps the unprocessed sound inputs 14, 18 sound features, i.e. the characteristic parameters. These features can be signal power, spectral data and other well-known features.

The sound environment detector 26 further comprises an environment classifier 32 for categorizing the sound environment based on the determined characteristic parameters. The environment classifier categorizes the sounds into a number of environmental classes, such as speech, babble speech, restaurant clatter, music, traffic noise, etc. The classification process may consist of a simple nearest neighbour search, a neural network, a Hidden Markov Model system or another system capable of pattern recognition. The output of the environmental classification can be a "hard" classification containing one single environmental class or a set of probabilities indicating the probabilities of the sound belonging to the respective classes. Other outputs may also be applicable.

The sound environment detector 26 further comprises a parameter map 34 for the provision of outputs 28 for selection of the signal processing algorithms.

The parameter map 34 maps the output of the environment classification 32 to a set of parameters for the hearing aid sound processor 20. Examples of such parameters are amount of noise reduction, amount of gain and amount of HF gain. Other parameters may be included.

FIGS. 2-5 illustrate various preferred embodiments of the present invention. The illustrated binaural hearing aid system 1 comprises a first hearing aid 10 and a second hearing aid 10', each of which comprises a first microphone 12, 12' and an A/D converter (not shown) and a second microphone 16, 16' and A/D converter (not shown) for provision of a digital input signals 14, 14', 18, 18' in response to sound signals received at the respective microphones 12, 12', 16, 16' in a sound environment, a processor 20, 20' that is adapted to process the digital input signals 14, 18, 14', 18' in accordance with a predetermined signal processing algorithm to generate a processed output signal 22, 22', and a D/A converter (not shown) and an output transducer 24, 24' for conversion of the respective processed sound signals 22, 22' to an acoustic output signal In the embodiments illustrated in FIGS. 2-4, each of the hearing aids 10, 10' of the binaural hearing aid system 1 further comprises a binaural sound environment detector 26, 26' for determination of the sound environment surrounding a user of the binaural hearing aid system 1. The determination is based on the output signals of the microphones 12, 12', 16, 16'. Based on the determination, the binaural sound environment detector 26, 26' provides outputs 28, 28' to the hearing aid processors 20, 20' for selection of the signal processing algorithm appropriate in the determined sound environment. Thus, the binaural sound environment detectors 26, 26' determines the sound environment based on signals from both hearing aids, i.e. binaurally, whereby hearing aid processors 20, 20' is automatically switched in co-ordination to the most suitable algorithm for the determined environment whereby optimum sound quality and/or speech intelligibility is maintained in various sound environments by the binaural hearing aid system 1.

Figure 2:
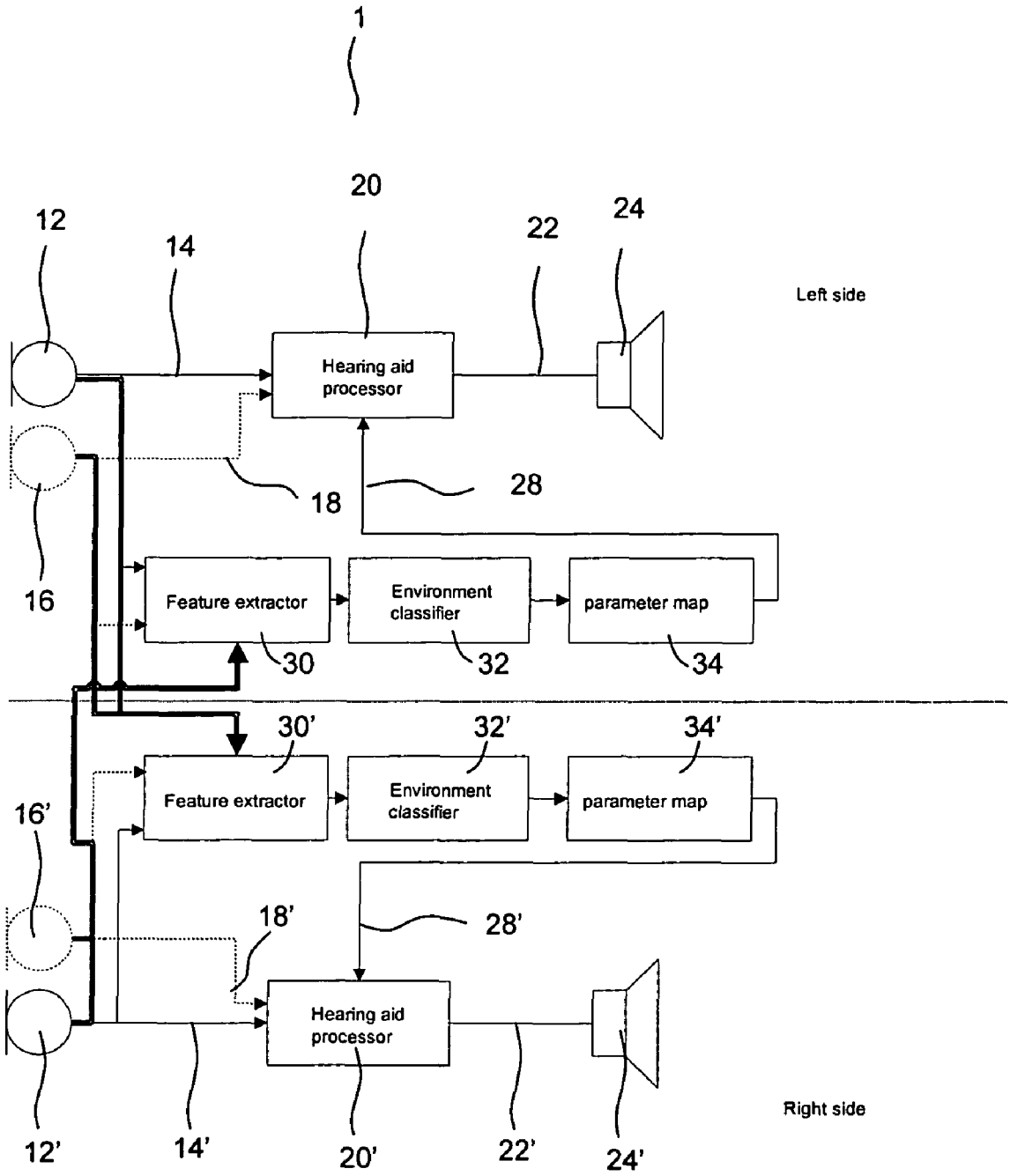
FIG. 2 illustrates schematically a first embodiment of the present invention.
Figure 3:
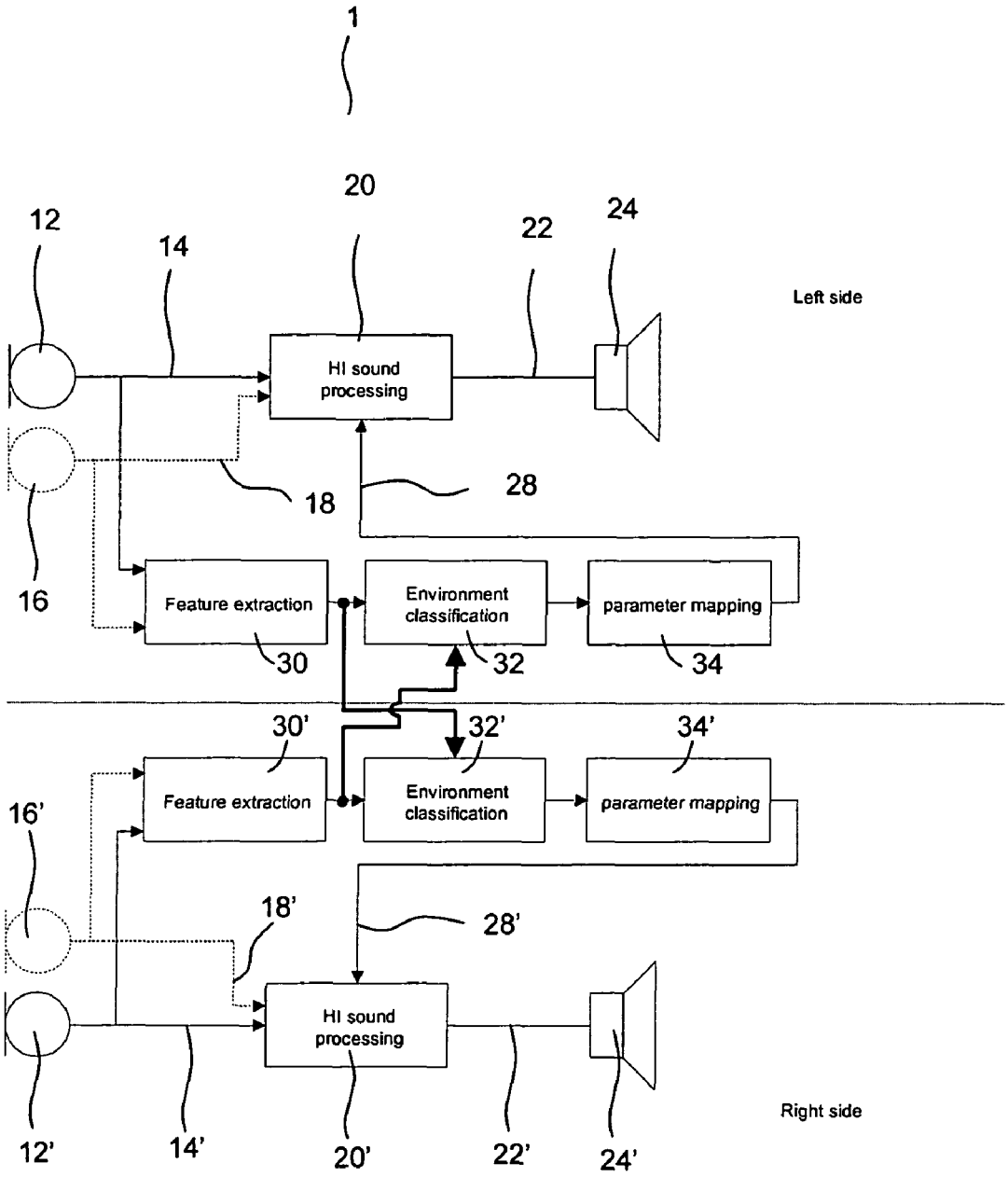
FIG. 3 illustrates schematically a second embodiment of the present invention.
Figure 4:
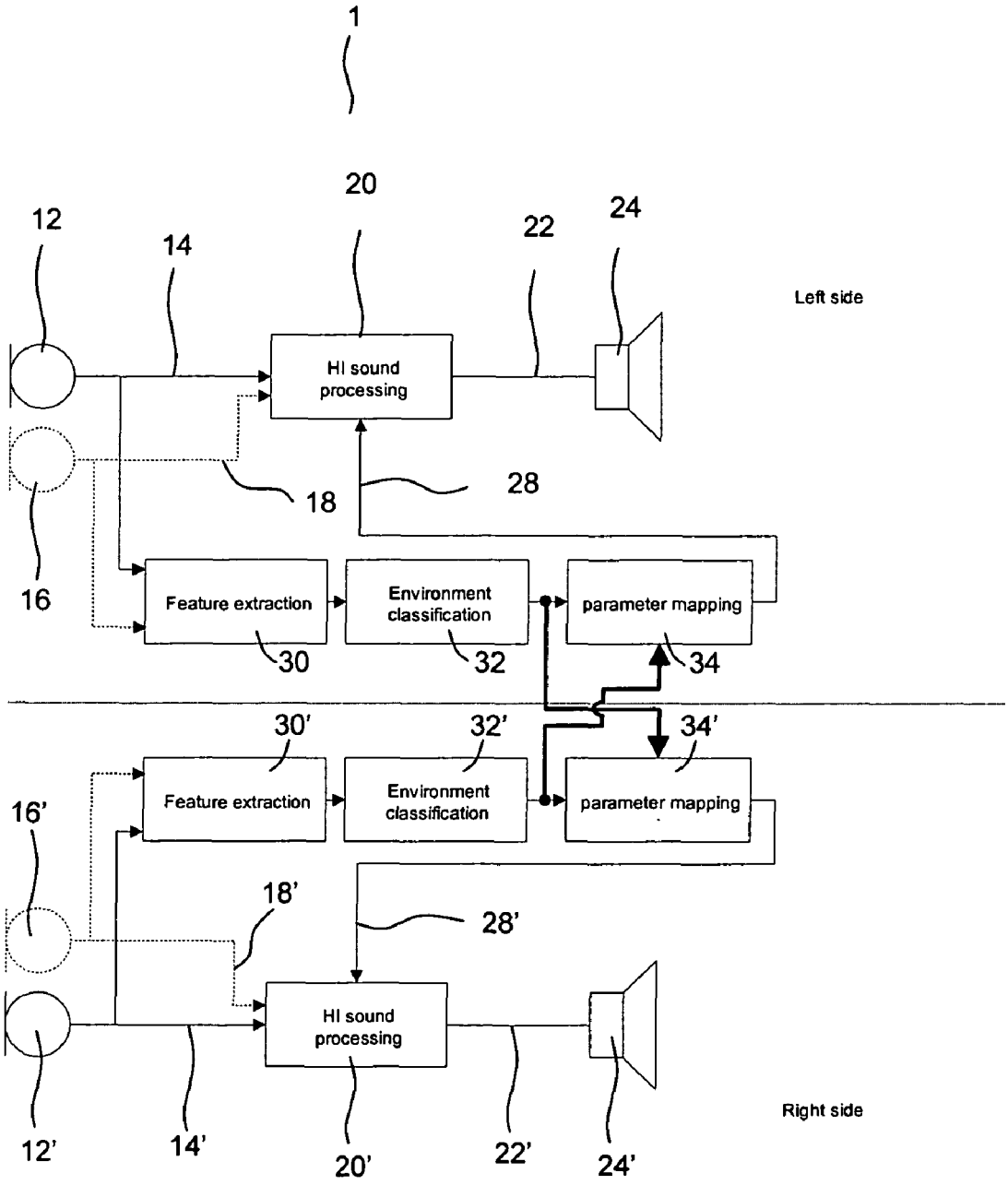
FIG. 4 illustrates schematically a third embodiment of the present invention.

The binaural sound environment detectors 26, 26' illustrated in FIGS. 2-4 are both similar to the binaural sound environment detector shown in FIG. 1 apart from the fact that the monaural environment detector only receives inputs from one hearing aid while each of the binaural sound environment detectors 26, 26' receives inputs from both hearing aids. Thus, according to the present invention, signals are transmitted between the hearing aids 10, 10' so that the algorithms executed by the signal processors 20, 20' are selected in co-ordination, e.g. in case of an omni-directional sound environment, i.e. the sound environment does not change with direction, the algorithms are selected to be identical apart from possible differences in hearing loss compensation of the two ears.

In the embodiment of FIG. 2, the unprocessed signals 14, 14', 18, 18' from the microphones 12, 12', 16, 16' of one hearing aid 10, 10' are transmitted to the other hearing aid and inputted to the respective feature extractor 30, 30'. Thus, feature extraction in each of the hearing aids is based on the identical four input signals so that identical sound environment characteristic parameters will be determined binaurally in both hearing aids 10, 10'.

The signals may be transmitted in analogue form or in digital form, and the communication channel may be wired or wireless.

In the embodiment shown in FIG. 3, the output 36, 36' of the feature extractor 30, 30' of one hearing aid 10, 10' is transmitted to the respective other hearing aid 10', 10. The environment classifier 32, 32' then operates on two sets of features 36, 36' to determine the environment. Since both environment classifiers 32, 32' receive the same data, they will produce the same output.

In the embodiment shown in FIG. 4, the output 38, 38' of the environment classifier 32, 32' of one hearing aid 10, 10' is transmitted to the respective other hearing aid 10, 10'. The parameter map 34, 34' then operates on two inputs 38, 38' to produce the parameters for the processor algorithms, but since both parameter mapping units 34, 34' receive identical inputs, identical parameter values will be produced.

This embodiment has a number of advantages: Usually classification systems take both past and present data into account—they have memory. This makes them sensitive to missing data, since a classification requires a complete data set. Therefore it is required that the data link is safe, in the sense that data is guaranteed to be transmitted. The parameter mapping can be implemented without memory so that only present data is taken into account when generating parameters. This makes the system robust to packet loss and latency, since the parameter mapping may simply re-use old data in the event that data is missing. This will of course delay the correct action, but to the user the systems will appear to be synchronized.

The transmission data rate is low, since only a set of probabilities or logic values for the environment classes has to be transmitted.

Rather high latency can be accepted. By applying time constants to the variables that will change according to the output of the parameter mapping it is possible to smooth out any differences that is caused by latency. As described earlier it is important that signal processing in the two hearing instruments is coordinated. However if transition periods of a few seconds are allowed the system can operate with only 3-4 transmissions per second. Hereby, power consumption is kept low.

Figure 5:
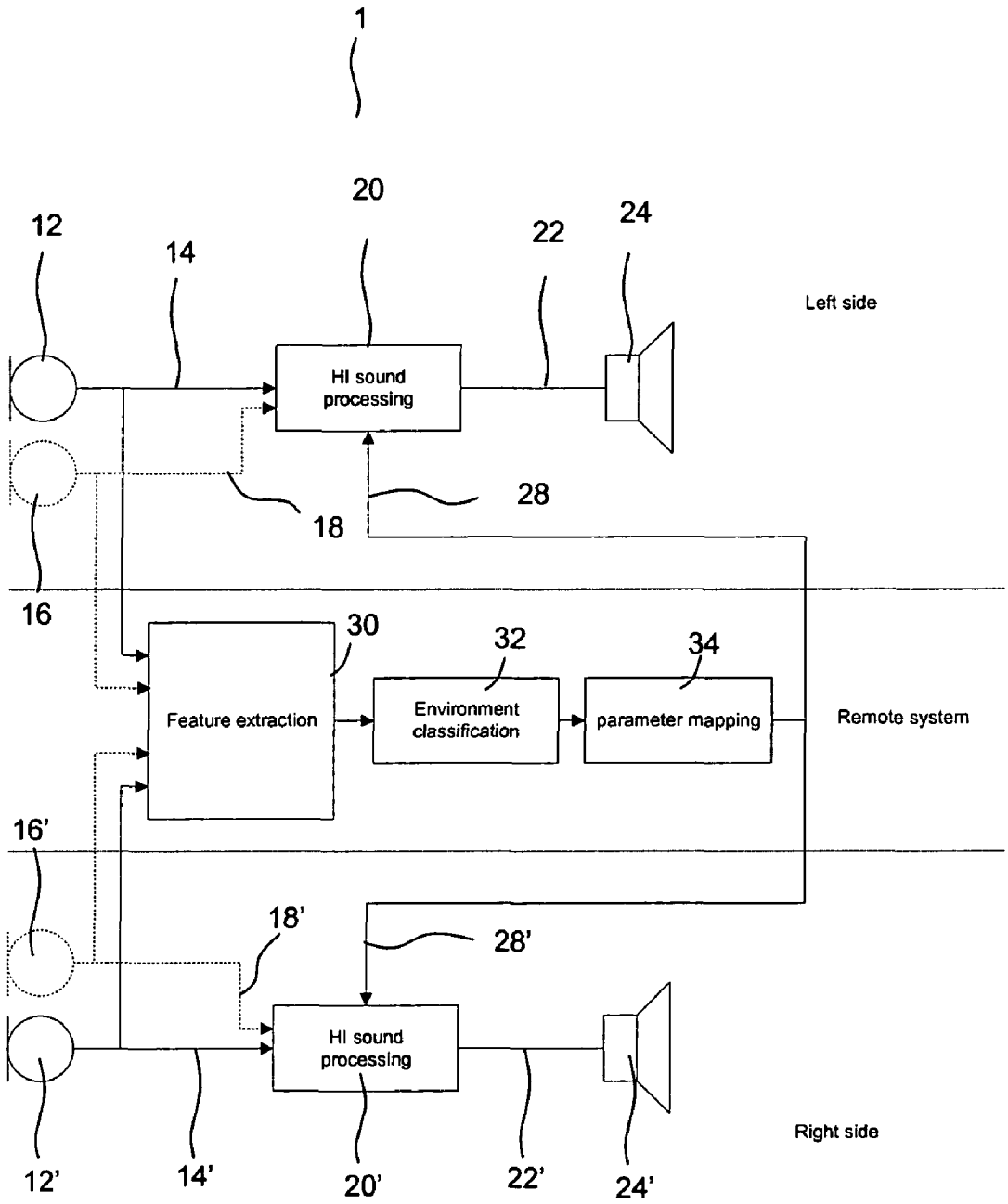
FIG. 5 illustrates schematically a fourth embodiment of the present invention.

A binaural hearing aid system 1 with a remote control 40 is shown in FIG. 5. The environment detector 26 is positioned in the remote control 40. The required signals are transmitted to and from both hearing aids.

The invention claimed is:

1. A binaural hearing aid system comprising a first hearing aid and a second hearing aid, each of which comprising a microphone and an A/D converter for provision of a digital input signal in response to sound signals received at the respective microphone in a sound environment surrounding a user of the binaural hearing aid system, a processor that is configured to process the digital input signal in accordance with a predetermined signal processing algorithm to generate a processed output signal, a D/A converter and an output transducer for conversion of the respective processed output signal to an acoustic output signal, and a binaural sound environment detector for binaural determination of the sound environment, the binaural sound environment detector comprising a feature extractor for determination of characteristic parameters of the received sound signals, an environment classifier for categorizing the sound environment based at least in part on the determined characteristic parameters, and a parameter map for provision of an output for a selection of the signal processing algorithm, wherein each of the parameter maps of the first and second hearing aid is configured to receive a first output from the environment classifier of the first hearing aid and a second output from the environment classifier of the second hearing aid, and generate the output for the selection of the signal processing algorithm.

2. The binaural hearing aid system of claim 1, wherein the first output corresponds with an environment classification determined by the environment classifier of the first hearing aid, and the second output corresponds with an environment classification determined by the environment classifier of the second hearing aid.

3. The binaural hearing aid system of claim 1, wherein the environment classifier of each of the first and second hearing aids is configured to communicate wirelessly.

4. The binaural hearing aid system of claim 1, wherein first output and the second output are in digital form.

5. The binaural hearing aid system of claim 1, wherein an interval between data communication between the first and second hearing aids is at least 250 ms.

6. The binaural hearing aid system of claim 1, wherein the environment classifier of either the first or the second hearing aid is configured to categorize the sound environment as an environment class selected from the group consisting of speech, babble speech, restaurant clatter, music and traffic noise.

7. The binaural hearing aid system of claim 1, wherein the first output of the environment classifier of the first hearing aid comprises a plurality of values corresponding to probabilities of sound belonging to different environment classes.

8. The binaural hearing aid system of claim 1, wherein the first output of the environment classifier of the first hearing aid corresponds to a selection of an environment class from a plurality of environment classes.

9. The binaural hearing aid system of claim 1, wherein the first input or the second input comprises information regarding a time interval between two events of data transmission.

10. The binaural hearing aid system of claim 1, wherein the parameter map of the first or second hearing aid is configured to control at least one parameter selected from the group consisting of an amount of noise reduction, an amount of broadband gain, an amount of frequency specific gain, a corner frequency of a frequency selective filter, a slope of a frequency selective filter, a knee-point of an AGC algorithm, a compression ratio of an AGC algorithm, and a directionality of a microphone.

11. A binaural hearing aid system having a first hearing aid, the first hearing aid comprising:

a microphone and an AID converter for provision of a digital signal in response to sound signal received at the microphone in a sound environment surrounding a user of the binaural hearing aid system;

a processor that is configured to process the digital signals in accordance with a predetermined signal processing algorithm to generate a processed output signal;

a D/A converter and an output transducer for conversion of the processed output signal to an acoustic output signal;

a feature extractor for determination of characteristic parameters of the received sound signals;

an environment classifier for categorizing the sound environment based at least in part on the determined characteristic parameters; and a parameter map for provision of an output for a selection of the signal processing algorithm;

wherein the parameter map is configured to receive a first output from the environment classifier and a second output from an environment classifier of a second hearing aid, and generate the output for the selection of the signal processing algorithm.

12. The binaural hearing aid system of claim 11, wherein the first output corresponds with an environment classification determined by the environment classifier of the first hearing aid, and the second output corresponds with an environment classification determined by the environment classifier of the second hearing aid.

13. The binaural hearing aid system of claim 11, wherein the environment classifier of the first hearing aid is configured to communicate wirelessly to a parameter map of the second hearing aid.

14. The binaural hearing aid system of claim 11, wherein first output and the second output are in digital form.

15. The binaural hearing aid system of claim 11, wherein an interval between data communication between the first and second hearing aids is at least 250 ms.

16. The binaural hearing aid system of claim 11, wherein the environment classifier of the first hearing aid is configured to categorize the sound environment as an environment class selected from the group consisting of speech, babble speech, restaurant clatter, music and traffic noise.

17. The binaural hearing aid system of claim 11, wherein the first output of the environment classifier of the first hearing aid comprises a plurality of values corresponding to probabilities of sound belonging to different environment classes.

18. The binaural hearing aid system of claim 11, wherein the first output of the environment classifier of the first hearing aid corresponds to a selection of an environment class from a plurality of environment classes.

19. The binaural hearing aid system of claim 11, wherein the first input or the second input comprises information regarding a time interval between two events of data transmission.

20. The binaural hearing aid system of claim 11, wherein the parameter map of the first hearing aid is configured to control at least one parameter selected from the group consisting of an amount of noise reduction, an amount of broadband gain, an amount of frequency specific gain, a corner frequency of a frequency selective filter, a slope of a frequency selective filter, a knee-point of an AGC algorithm, a compression ratio of an AGC algorithm, and a directionality of a microphone.

21. The binaural hearing aid system of claim 11, further comprising the second hearing aid.

22. The binaural hearing aid system of claim 1, wherein each of the parameter maps of the first and second hearing aid is configured to generate the output for the selection of the signal processing algorithm based on the first output from the environment classifier of the first hearing aid and the second output from the environment classifier of the second hearing aid.

23. The binaural hearing aid system of claim 11, wherein the parameter map is configured to generate the output for the selection of the signal processing algorithm based on the first output from the environment classifier and the second output from an environment classifier of a second hearing aid.

* * * * *